United States Patent [19]

Jahn

[11] 4,174,909

[45] Nov. 20, 1979

[54] LOOSE LEAF BINDER

[76] Inventor: Gerhard Jahn, 655 Broadview Ave., Apt. 1907, Toronto, Ontario, Canada

[21] Appl. No.: 850,051

[22] Filed: Nov. 9, 1977

Related U.S. Application Data

[63] Continuation of Ser. No. 677,297, Apr. 15, 1976, abandoned, and Ser. No. 490,093, Jul. 19, 1973, abandoned.

[51] Int. Cl.[2] ..... A47L 13/26

[52] U.S. Cl. ..... 402/13; 402/75

[58] Field of Search ..... 402/15, 8, 13, 75; 24/16 PB

[56] References Cited

U.S. PATENT DOCUMENTS

| | | | |
|---|---|---|---|
| 2,042,366 | 5/1936 | Swank | 402/15 |
| 2,133,069 | 11/1938 | Williamson | 402/15 |
| 2,329,786 | 9/1943 | Ringler | 402/8 |
| 2,445,671 | 7/1948 | Johnson | 402/75 |
| 2,451,122 | 10/1948 | Sherwood | 402/15 X |
| 2,468,355 | 4/1949 | Ambler | 402/15 |
| 2,575,583 | 11/1951 | Clarke et al. | 402/15 |
| 2,911,977 | 11/1959 | French | 402/15 X |
| 2,961,785 | 11/1960 | Toepfer | 24/16 PB |
| 3,318,354 | 5/1967 | Borisof | 402/15 X |

FOREIGN PATENT DOCUMENTS

| | | | |
|---|---|---|---|
| 272010 | 2/1930 | Italy | 282/29 C |
| 846761 | 8/1960 | United Kingdom | 24/16 PB |

*Primary Examiner*—Willie G. Abercrombie

[57] ABSTRACT

A binder is provided manufactured in a single step operation from a single sheet of material and comprises front and back covers, a backing intermediate the two, and fastening means manufactured in one of the back covers and slot arrangements disposed adjacent to, or in, the backing to lock the fastening means. The binder is thus very inexpensive to manufacture and is easily used by industry in large quantities.

3 Claims, 6 Drawing Figures

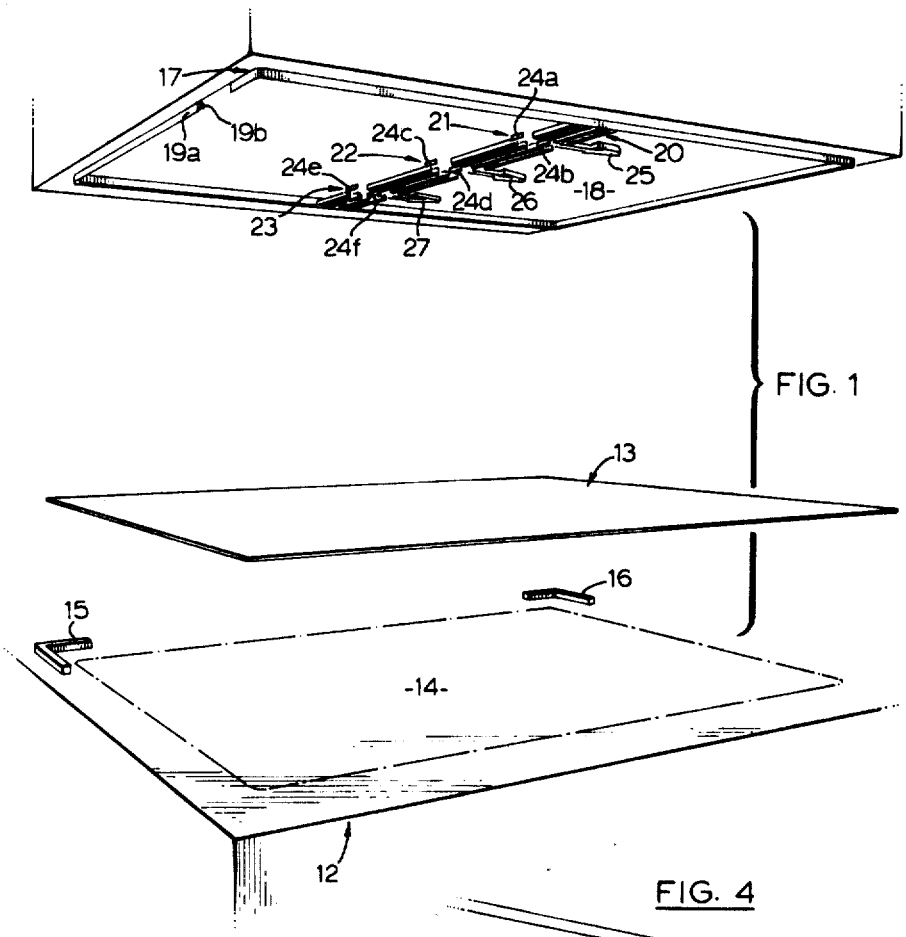
FIG. 1
FIG. 4
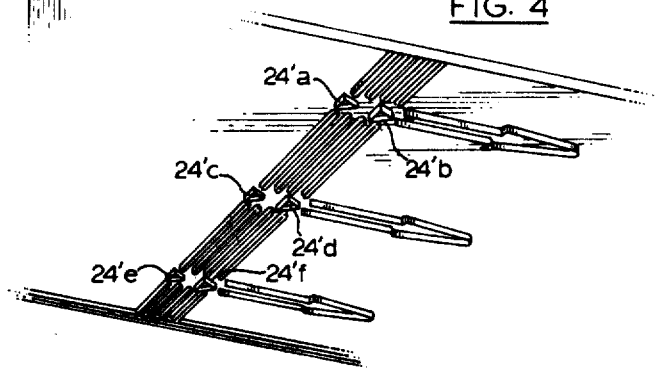

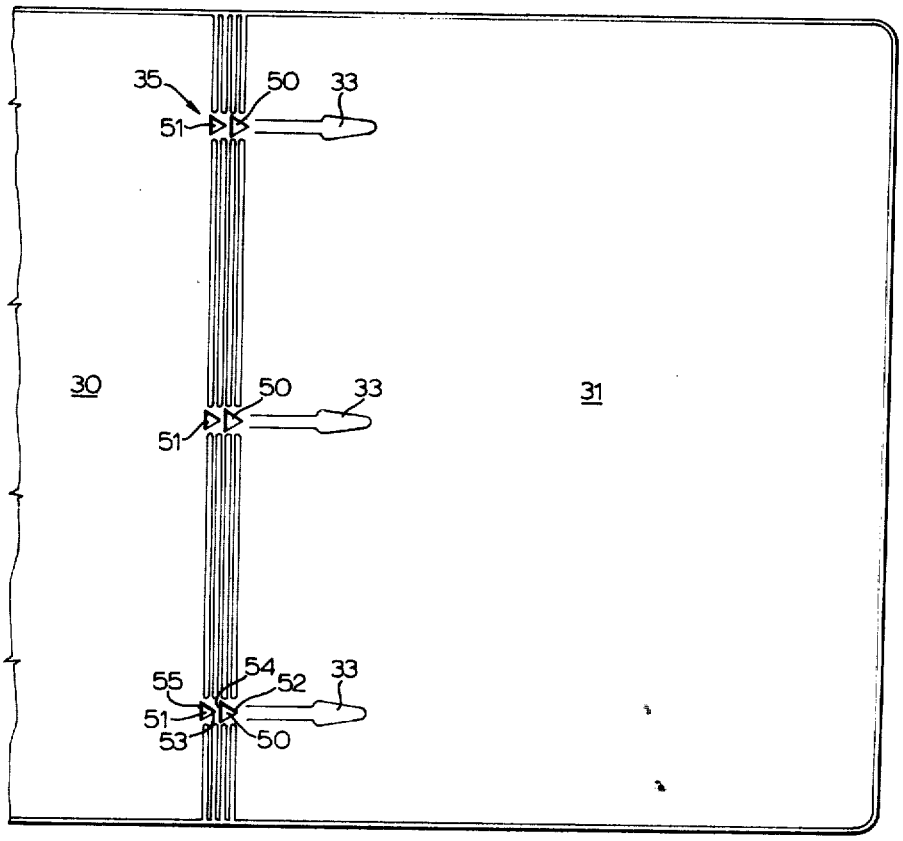
FIG. 5
FIG. 6
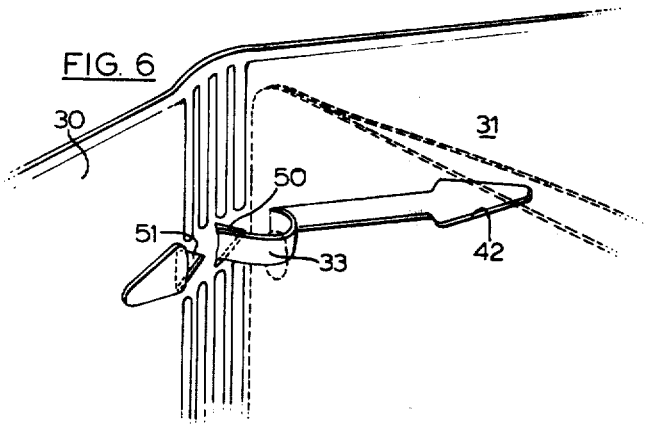

LOOSE LEAF BINDER

This is a continuation of application Ser. No. 677,297 filed Apr. 15, 1976 and application Ser. No. 490,093 filed July 19, 1973, both abandoned.

FIELD OF INVENTION

This invention relates to binders, and more particularly, to a loose leaf binder manufactured in a one step operation from a single sheet of material.

BACKGROUND OF THE INVENTION

Most binders today are manufactured by joining together various individual components manufactured separately and later assembled to form the finished product. More particularly, loose leaf binders have been manufactured by heat sealing front and back sheets of a plastic or polymeric material to sandwich a cardboard core to form front and back covers and a backing intermediate the two, and then securing metallic rings to the backing of the binder which method of manufacture was both time consuming and costly.

In my co-pending U.S. application Ser. No. 289,280 now U.S. Pat. No. 3,834,824 I disclosed a unique retaining means which can be substituted for the metallic rings. However, this retaining means must still be secured to the completed backing-cover combination of the binder by a separate operation, exclusive of its manufacture, with the result that material and time are wasted, very important considerations today when the cost of polymeric or plastics material, and labour have drastically escalated. Therefore binders have become less attractive as a display for use by salesmen of large companies (e.g. insurance companies) for presentation of their products and services.

It is therefore an object of this invention to provide a binder and a method of manufacture therefor, where material wastage and labour costs are reduced.

It is a further object of the invention to provide a binder utilizing less material than the prior art binders.

It is still a further object of this invention to provide a highly reliable binder, manufactured from a single sheet of material in a one step operation.

Further and other objects and advantages of the invention will be seen by those skilled in the art from the following summary of the invention and detailed description of two preferred embodiments thereof.

SUMMARY OF THE INVENTION

According to one important aspect of the invention a complete binder is manufactured in a single operation from a single sheet of material.

According to another important aspect of the invention, each fastening means in the binder comprises a strap and tab at one end of the strap, formed integrally from, and adjacent to the center of, the single sheet of material, the strap remaining attached at one end to the material and forms a continuation of the plane of the material at the juncture of the strap and material.

According to another important aspect of the invention, slot arrangements are provided, adjacent the centre of the material, one for each fastening means, to lock and secure the fastening means preferably, within the interior of the binder. The slot arrangement therefore preferably comprises an even number of slots, for example two slots, a first and second slot aligned in substantially parallel relation to one another, viewed with respect to their individual lengths, to receive the fastening means therethrough. Preferably the slot remote from the fastening means, for example the second slot, is slightly shorter than the maximum width of the tab of the fastening means.

According to another important aspect of the invention the binder is manufactured by positioning a sheet of material or a portion thereof, when a roll of material is used, and substantially simultaneously, either by heat sealing or die cutting, shaping and sizing said sheet and additionally severing a portion of material from the roll, if a roll of material is used, and forming the above described fastening means and slot arrangement in the sheet.

BRIEF DESCRIPTION OF THE DRAWINGS

Although this invention finds wide application in the manufacture of binders and related products, the invention will be illustrated with respect to two preferred embodiments illustrated in the attached drawings in which:

FIG. 1 is a perspective exploded view of a sheet of material and requisite components of an apparatus used to form a binder according to a preferred embodiment of the invention.

FIG. 4 is a close up view of a portion of the apparatus of FIG. 1, modified according to a further preferred embodiment of the invention.

FIG. 5 is a plan view of a portion of the interior of the binder formed by the apparatus of FIG. 4.

FIG. 6 is a close-up of a portion of the binder of FIG. 6 illustrating the securing of the fastening means through the slot arrangement according to the further preferred embodiment of the invention.

DETAILED DESCRIPTION OF TWO PREFERRED EMBODIMENTS OF THE INVENTION

Figure 2:
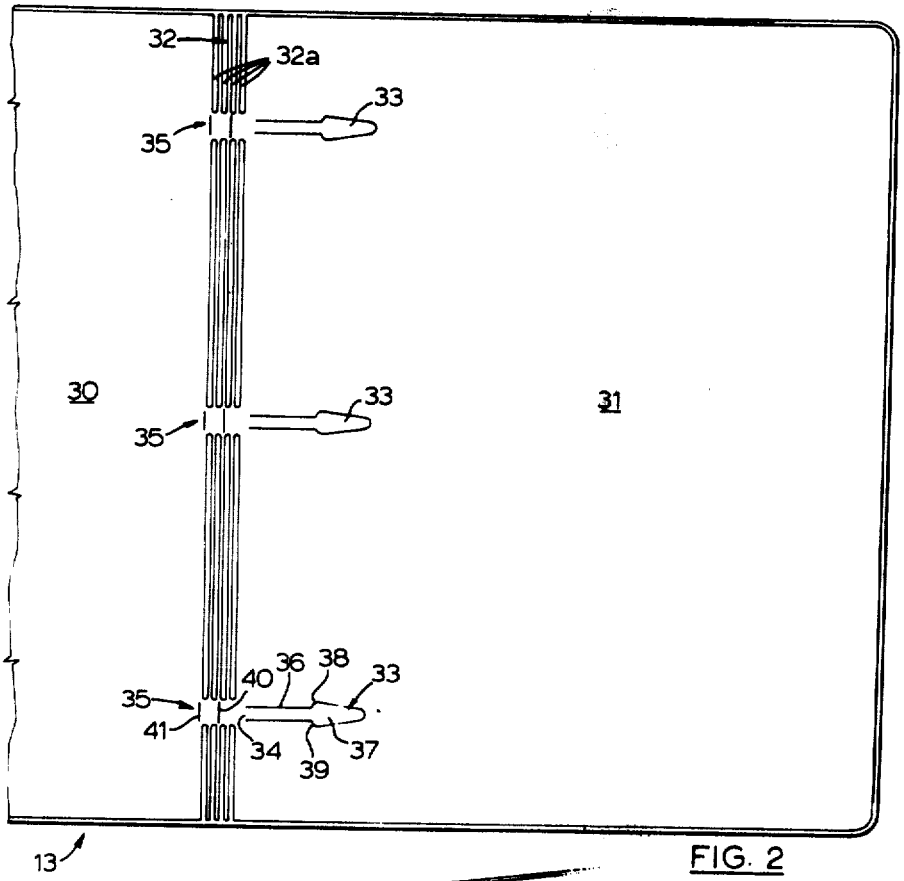
FIG. 2 is a plan view of a portion of the interior of the binder formed by the apparatus of FIG. 1.
Figure 3:
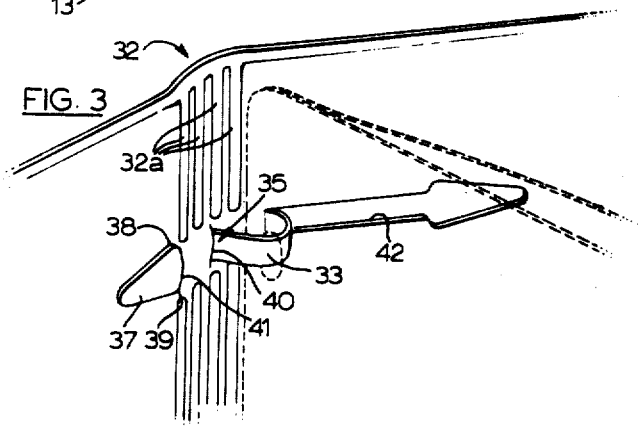
FIG. 3 is a close-up of a portion of the binder of FIG. 2 illustrating the securing of the fastening means through the slot arrangement according to the above preferred embodiment of the invention.

Referring to FIGS. 1, 2 and 3, conventional heat sealing apparatus known in the art is provided for carrying out the process according to this preferred embodiment of the invention and comprises a base 12, on which a sheet of material 13 is disposed. Base 12 has, on the upper surface thereof, a sponge material 14 on which the material will seat and has at the corners, right angles 15 and 16 (the other two not being shown) for precisely positioning the sheet of material in relation to the apparatus. Upper plate 17 is reciprocally moveable vertically from a position spaced from the base 12 to a position proximate the base 12 to contact the sheet of material 13 for a predetermined length of time, and then vertically elevated to its original position. On the under-surface 18 of plate 17 are disposed cutting and sealing rules known in the art, of predetermined shape and size and so positioned for the purposes hereinafter described. Adjacent the periphery of under-surface 18, are endless cutting and sealing rules 19A and 19B, sealing rule 19B being interior of cutting rule 19A and recessed relative thereto, for cutting sheet of material 13 to a specific size and shape, in this case rectangular, and finishing the edges thereof, respectively. Disposed at the centre of the area enclosed by endless sliding rule 19B of undersurface 18 are transverse sealing rules 20 (in this case 4) being interrupted at portions 21, 22 and 23. These rules when contactng the material do not cut through the material but rather bulge the material by concentrating the material outwardly at the points of contact to form ribs for folding. Parallel cutting rules 24*a* and 24*b*, 24*c* and 24*d*, and 24*e* and 24*f* are disposed in spaces 21, 22 and 23, respectively to form linear slots in the material when the apparatus is in operative contact with the material. Rules 24*a*, 24*c* and 24*e* are preferably slightly shorter than rules 24*b*, 24*d* and 24*f*. The cutting rules 25, 26 and 27 are so shaped to produce the strap and tab combination, i.e. the fastening means, of the description hereinafter provided.

When plate 17 is lowered to contact sheet 13 and the electrical current directed through the various rules on the undersurface 18 of plate 17, the material 13 is appropriately cut by the cutting rules or sealed by the sealing rules, with the resultant formation of the binder, only a portion of which is shown in FIG. 2.

Referring to FIG. 2, this binder is of a one step construction manufactured from the single sheet of material 13 and comprises both front cover 30 and back cover 31, a backing 32 disposed intermediate the two having transverse ribbing 32*a* permit closure of the binder, a plurality of fastening means 33 each fastening means comprising a strap 36 and tab 37 formed integrally from one portion of the back cover 31, which fastening means forms a continuation of the plane of the cover 31 at the juncture 34 of the fastening means 33 and the cover 31. The tab 37 at the end of the fastening means forms a continuation of the plane of the strap and is of a width at the juncture with the strap to define therewith a pair of locking shoulders 38 and 39. The tab 37 is tapered from a wider portion adjacent the locking shoulders 38 and 39 to a narrower portion at its tip. A plurality of slot arrangements 35, have been provided, one slot arrangement for each fastening means, to coact with the fastening means when the fastening means is inserted therethrough to lock and secure the fastening means 33 in the interior of the binder.

Each slot arrangement 35 formed by, for example cutting rules 24*a* and 24*b* comprises two slots, a first slot 40 and a second slot 41, the first slot being intermediate the second slot and fastening means. Slot 40 may be slightly longer than slot 41 as perferably is the maximum width of tab 37. The fastening means 33 and slot arrangement 35 are so disposed in the binder cover 33 and backing 32 respectively that they are aligned such that on presentation of the tab to the slot arrangement, the tab on being threaded through the first slot 40 is disposed exterior of the binder and on being threaded through slot 41 is brought back into the interior of the binder. If slot 41 is smaller than the maximum width of tab 37, the tab 37 will buckle out of its planar configuration when it is threaded through slot 41 to lock the tab and thus the fastening means in the interior of the binder. To return tab 37 through the slot arrangement to disengage the fastening means, tab 37 must be again buckled out of its planar configuration and returned through slot 41 and then through slot 40. FIG. 3 illustrates in close-up the fastening means 33 locked by slot arrangement 35. The cut-out portion 42, seen in FIG. 3, which retained fastening means 33, is in the back cover and is not noticed when the binder is used. However, when noticed it does not detract from the overall appearance of the binder.

FIGS. 4, 5 and 6 illustrate the same apparatus disclosed in FIG. 1 used to carry out the process for manufacturing another preferred embodiment of the invention and the resultant binder manufactured thereby except that cutting rules 24*a*, 24*b*, 24*c*, 24*d*, 24*e* and 24*f* are replaced by triangular cutting rules 24'*a*, 24'*b*, 24'*c*, 24'*d*, 24'*e* and 24,*f*. Therefore when the binder is formed, each slot arrangement comprises two triangular slots 50 and 51 (seen best in FIGS. 5 and 6) having their shortest portions 52 and 53 respectively nearer the fastening means than their longest portions 54 and 55 respectively. It is of course to be understood that the rules 24'*a*, 24'*b*, 24'*c*, 24'*d*, 24'*e* and 24'*f*, may be modified to be ">" shaped, the rear most portion of the triangular cutting rules parallel to sealing rules 20 (see FIGS. 1 and 4) being deleted so that slots 50 and 51 in construction will actually be a ">" shaped cut which provides a flap covering a triangular slot.

In this embodiment, the first slot is preferably slightly longer at its longest portion than the maximum width of the tab and the maximum length of the second slot is slightly shorter preferably about 5% shorter, than the widest portion of the tab.

To secure the fastening means of the binder in FIG. 5, through modified slot arrangement 35, the tab is presented to slot 50 and pushed therethrough to the exterior of the binder at a portion of slot 50 which is longer than the widest portion of the tab. It is then presented to slot 51 and by pushing the tab towrds the slot in the direction of the divergence of the slot from the shorter portion to the longer portion with the plane of the tab transverse the length of the slot, the tab will first cooperate with the divergent side walls of the slot between the shorter portion and the longer portion to seek a longer slot portion and under further pushing the tab will thereupon resiliently buckle out of its planar configuration sufficiently to pass through the slot and thereupon recover to its planar configuration with its shoulders located in the interior of the binder in a minimum locking position. The strap may then be pulled in the reverse direction which will return the tab in the direction of the converging side walls of the slot from a longer portion to the shorter portion to locate the locking shoulders in a maximum locking position to prevent tab removal therefrom until sufficient force is exerted to buckle the tab out of its planar configuration to a degree substantially greater than the buckling required for insertion of the tab through the slot. Of course if a flap is provided over slot 51 by the method hereinbefore described using the ">" rule, the flap will further assist in securing the tab within the interior of the binder. In particular, when the tab is presented beneath the flap in the direction of the divergence of the flap and slot from the shorter portion to the longer portion, with the plane of the tab transverse the length of the slot, the tab on being pushed beneath the flap into the slot by the strap at the shorter portion, will first co-operate with the undersurface of the flap and the divergent side walls of the slot between the shorter and longer portions to seek a longer slot portion and under further pushing the tab will thereupon resiliently buckle out of its planar configuration sufficiently to pass through the slot and thereupon recover to its planar configuration with its shoulders located behind the backing in a minimum locking position, the strap on being pulled in the reverse direction will return the tab, deflected by the flap, in the direction of the converging sides of the said slot from said longer portion to said shorter portion to locate the locking shoulders behind the backing in a maximum locking position to prevent tab removal therefrom until sufficient force is exerted to buckle the tab out of its planar configuration to a degree substantially greater than the buckling required for insertion of the tab through the slot.

Since the slots could be made, for example, semicircular, or parabolic in shape and various combinations of the slots used together in the construction of the binder without departing from the scope of the invention it is intended that all matter contained in the specification and the appended drawings, shall be interpreted as illustrative of the invention and shall not be interpreted in a limiting sense.

I claim:

1. A binder formed from a single sheet of material comprising front and back covers and a spine disposed therebetween and about the center line of which said covers swing in opening and closing the binder, a plurality of fastening means formed integrally from one of said covers and each comprising a thin narrow bendable strap of substantially uniform width throughout its length and having its root located adjacent to said spine and extending transversely away from said spine center line and terminating in an enlarged tab, a plurality of openings disposed in said spine adjacent to the center line thereof and having at least a portion thereof clear of that portion of the spine which lies between said center line and the other of said covers, whereby swinging movement of said other cover about said spine center line does not alter the distance between the roots of said straps and said opening portions, said openings being in aligned relation with said fastening means and being adapted to accept the passage of the tabs of said fastening means therethrough with a substantial portion of said fastening means constituted by said straps forming loops extending between said strap roots and said opening portions to accommodate a plurality of sheets of loose leaf material for free sliding movement therealong while permitting said covers to be opened about the center line of said spine into co-planar relation, said binder presenting further openings for receiving and holding said strap tabs against accidental removal to prevent accidental withdrawal of said fastening means from said first mentioned openings.

2. A binder as claimed in claim 1 in which said one cover is the back cover.

3. A binder as claimed in claim 1 in which said further openings are formed in said spine.

* * * * *